US009951683B2

(12) United States Patent
Artinian et al.

(10) Patent No.: US 9,951,683 B2
(45) Date of Patent: Apr. 24, 2018

(54) SUPPLEMENTAL ELECTROMAGNETIC TURBOCHARGER ACTUATOR

(71) Applicant: Calnetix Technologies LLC, Cerritos, CA (US)

(72) Inventors: Herman Artinian, Huntington Beach, CA (US); Larry Hawkins, Cerritos, CA (US); Patrick McMullen, Villa Park, CA (US); Keith Ropchock, Cerritos, CA (US); Venkateshwaran Krishnan, Seal Beach, CA (US)

(73) Assignee: Calnetix Technologies, LLC, Cerritos, CA (US)

( * ) Notice: Subject to any disclaimer, the term of this patent is extended or adjusted under 35 U.S.C. 154(b) by 446 days.

(21) Appl. No.: 14/657,569

(22) Filed: Mar. 13, 2015

(65) Prior Publication Data

US 2016/0265427 A1 Sep. 15, 2016

(51) Int. Cl.
*F02B 39/16* (2006.01)
*F01D 25/16* (2006.01)

(52) U.S. Cl.
CPC ..... *F02B 39/16* (2013.01); *F01D 25/16* (2013.01); *F02B 2039/162* (2013.01); *F05D 2220/40* (2013.01); *F05D 2240/511* (2013.01); *F05D 2240/515* (2013.01); *F05D 2240/52* (2013.01)

(58) Field of Classification Search
CPC ..... F01D 25/16; F01D 25/166; F01D 15/04; F05D 2240/51; F05D 2240/511; F05D 2240/515; F05D 2240/52; F16C 25/045; F16C 25/086; F16C 32/0402; F16C 32/0476
See application file for complete search history.

(56) References Cited

U.S. PATENT DOCUMENTS 5,253,985 A * 10/1993 Ruetz ..... F01D 25/164 384/473
6,353,273 B1 * 3/2002 Heshmat ..... F16C 17/024 310/90.5
7,723,883 B2 * 5/2010 Ozaki ..... F01D 15/005 310/90.5
2013/0239568 A1 * 9/2013 Krishnan ..... F02B 37/12 60/608

* cited by examiner

*Primary Examiner* — Woody Lee, Jr.
*Assistant Examiner* — Brian O Peters
(74) *Attorney, Agent, or Firm* — Fish & Richardson P.C.

(57) ABSTRACT

A turbocharger system for an engine includes a rotor, a primary bearing system arranged to axially and radially support the rotor to rotate on a central rotational axis, a compressor coupled to a rotor to rotate with the rotor, a turbine coupled to the rotor to rotate with the rotor, and an electromagnetic actuator adjacent to the rotor. The electromagnetic actuator selectively acts on the rotor and supplements the axial support of the primary bearing system by applying a magnetic force on the rotor in a direction parallel to the central rotational axis of the rotor.

19 Claims, 4 Drawing Sheets

SUPPLEMENTAL ELECTROMAGNETIC TURBOCHARGER ACTUATOR

BACKGROUND

The present disclosure relates to turbochargers.

A turbocharger is a device with a compressor carried on a common rotor with a turbine, where the turbine drives the compressor to generate compressed air for an engine using the engine's exhaust. Turbochargers often use oil-lubricated fluid film bearings for supporting the turbocharger rotor because fluid film bearings provide high load capacity and durability. Turbochargers for large marine engines are highly refined to operate efficiently at a specified steady-state operation, i.e., the nominal steaming operation, at which the marine vessel will operate continuously for hours, days, weeks, or longer. As the engine operation deviates from the nominal steaming operation, the efficiency of the turbocharger goes down. For example, when the vessel is "slow" steaming, i.e. operating at a slower speed and load than the nominal steaming operation, the loads on the turbocharger rotor are reduced. The turbocharger fluid film bearings, however, are sized to handle in excess of the engine's maximum operating conditions. Thus, at slow steaming, the bearing losses due to the fluid film bearings become a larger proportion of the losses in the turbocharger, impacting the performance of the turbocharger and thus engine efficiency. While reducing the oil flow rate to the fluid film bearings at lower turbocharger rotor loads can reduce the frictional bearing losses, this also can allow the rotor to shift axially, increasing the gap between the compressor and the interior of the housing. This larger gap allows a greater portion of air to bleed by the compressor, thus reducing the turbocharger (i.e., compressor) and engine efficiency.

DESCRIPTION OF DRAWINGS

Like reference symbols in the various drawings indicate like elements.

DETAILED DESCRIPTION

This disclosure encompasses a turbocharger with an electromagnetic actuator, for example, to supplement the primary bearing system of the turbocharger by selectively supporting some or all of an axial load on a rotor of the turbocharger based on engine operating conditions. The axial support provided by the electromagnetic actuator enables reducing the loads on the primary bearing system, thus reducing bearing losses in the turbocharger and increasing turbocharger efficiency, and thus engine efficiency, at lower than nominal operating conditions (e.g., slow steaming). In certain instances, the axial support provided by the electromagnetic actuator also enables reducing compressor bleed-by, thus reducing compressor losses and increasing turbocharger and engine efficiency at lower than nominal operating conditions (e.g., slow steaming).

Figure 1:
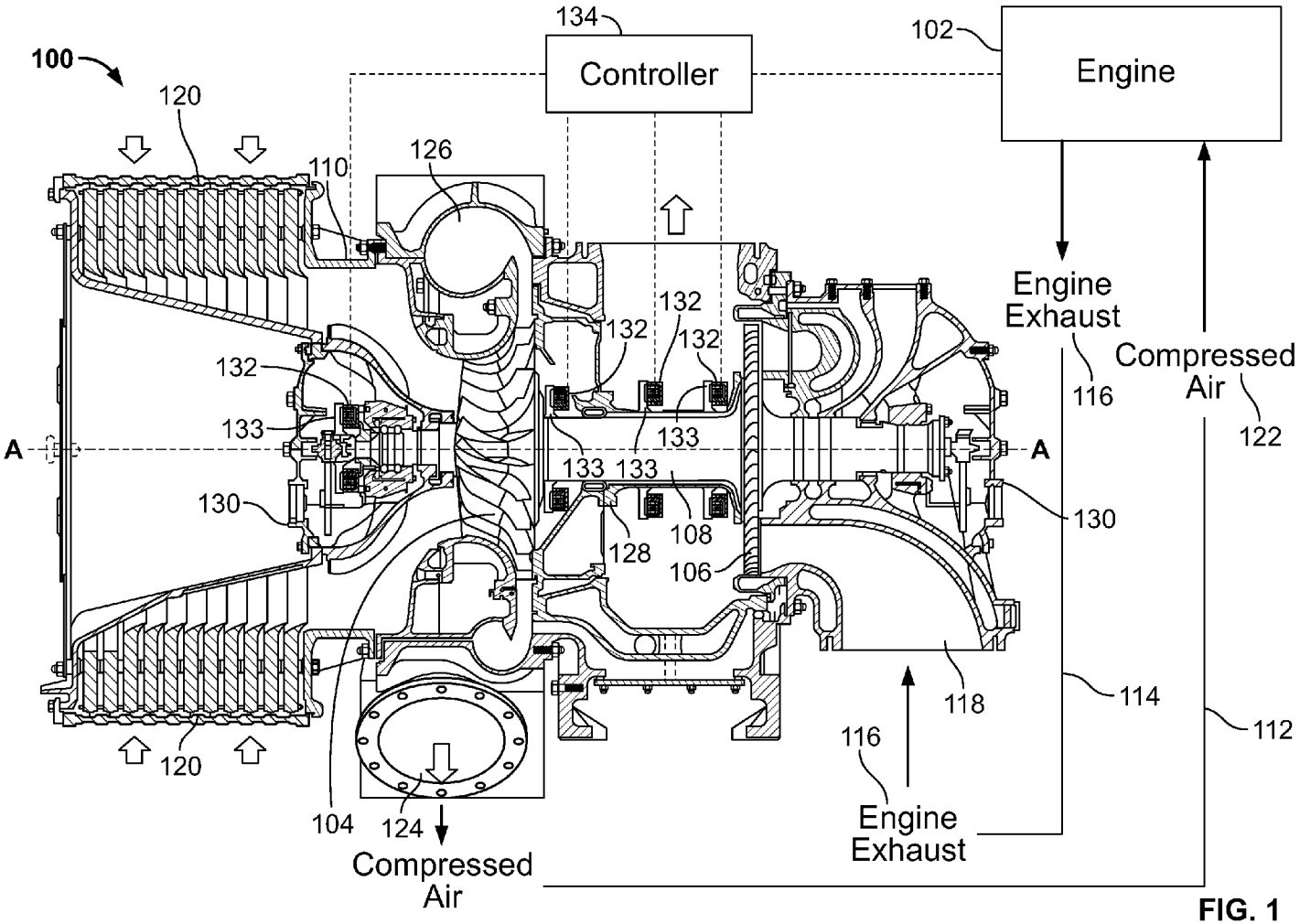
FIG. 1 is a partial cross-sectional side view of an example turbocharger for an engine.

FIG. 1 is a partial cross-sectional side view of an example turbocharger system 100 for an engine 102. In certain instances, the engine 102 is a very large engine, such as a fifteen megawatt marine diesel engine. However, the concepts herein can be applied to other different sizes of engines, as well as other different applications than marine diesel engine applications. The turbocharger system 100 includes a compressor 104 and a turbine 106, each coupled to a substantially cylindrical rotor 108 having a central rotational axis A-A. The compressor 104, turbine 106, and rotor 108 are uniaxially aligned along the central rotational axis and are housed within a turbocharger housing 110 that connects, directly or indirectly, the turbocharger system 100 to the engine 102 via a compressed air passageway 112 and an exhaust passageway 114. The compressor 104 and the turbine 106 of the example turbocharger system 100 are shown to include contoured blades extending radially from the rotor 108. Edges of the contoured blades of the compressor 104 and turbine 106 fit closely with an inner surface of the housing 110 and seal, to some degree, with the inner surface of the housing 110. The turbine blades are contoured to promote rotation of the turbine, for example, as air moving through the turbine engages with the turbine blades. The compressor blades are contoured to drive air through the compressor 104, for example, as the compressor blades rotate. FIG. 1 depicts a centrifugal compressor 104 and an axial turbine 106. However, the turbine blades and compressor blades can be shaped differently than depicted in FIG. 1.

During operation, the turbocharger system 100 receives engine exhaust 116 from the engine 102 through a turbine inlet 118. The exhaust 116 engages with the turbine blades to drive the turbine 106 to rotate. Rotation of the turbine 106 drives rotation of the rotor 108 about the central rotational axis A-A, and therefore effects rotation of the compressor 104 to draw in air from an air inlet 120, compress the air via the compressor 104, and output compressed air 122 through a compressor outlet 124. The compressor outlet 124 leads to an air intake of the engine 102, and the compressed air 122 can be used in the operation of the engine 102, for example, in the intake and combustion cycles of piston-cylinder engines.

The turbine 106 transfers kinetic and thermal energy from engine exhaust 116 from the engine 102 into rotation of the turbine 106, rotor 108, and compressor 104. For example, engine exhaust 116 can move through the exhaust passageway 114 and into the housing 110 toward the turbine 106, and act on the blades of the turbine 106 to rotate the turbine 106, and therefore rotate the rotor 108 and compressor 104. Rotation of the compressor 104 creates a pressure differential across the compressor 104 within the housing 110 that draws in and compresses air. For example, rotation of the compressor blades biases air to move past the compressor 104 from a lower pressure at the air inlet 120 to a higher pressure inside a volute 126 of the housing 110. The volute 126 substantially surrounds the edges of the compressor 104 to promote movement of compressed air from the compressor 104. The volute 126 can connect to the engine 102 via the compressor outlet 124 and compressed air passageway 112.

The turbocharger system 100 also includes a primary bearing system 128 configured to fully axially and radially support the rotor 108. The primary bearing system 128 can include a set of multiple bearings housed within a bearing enclosure 130 that acts to seal the primary bearing system 128 and enclose the rotor 108. Operation of the turbine 106, rotor 108, and compressor 104 effects a radial and axial force (e.g., thrust force) on the rotor 108 that the bearing system 128 supports. The primary bearing system 128 is shown in FIG. 1 as including multiple fluid film bearings spaced axially along the length of the rotor 108. However, the primary bearing system 128 can include additional or different features. For example, the primary bearing system 128 can include one or more ball or cartridge bearings and/or other types of bearings to support the radial and axial loads on the rotor 108. In certain instances, the primary bearing system 128 includes one or more axial bearings for axial support of the rotor 108, and one or more radial bearings for radial support of the rotor 108. In certain instances, the primary bearing system 128 includes one or more combination bearings that provide both axial support and radial support of the rotor 108.

The primary bearing system 128 is the primary bearing system because it is configured to support the full axial (thrust) and radial load on the rotor 108 at the maximum operational state of the engine 102 (maximum speed and/or power output) associated with the turbocharger system 100, and does so over extended operation of the engine 102, such as operation for hours, days, weeks or longer. Referring to FIG. 1, the thrust force is an axial force on the rotor 108 in a direction along the central rotational axis A-A. In some instances, the primary bearing system 128 is designed to be most efficient at the nominal steaming operational state of the engine 102, which sometimes correlates to the primary bearing system 128 being less efficient at an operational state of the engine 102 that is less than the nominal steaming operational state (e.g., slow steaming). The operational state of the engine 102 can vary, for example, in engine speed, engine power output, and/or other engine characteristics.

The example turbocharger system 100 is shown in FIG. 1 as having four electromagnetic actuators 132 adjacent to and spaced axially along the rotor 108 to selectively act on the rotor 108, for example, to apply a magnetic force on the rotor 108 in a direction parallel to the central rotational axis A-A of the rotor 108. The rotor 108 includes radially extending, disc-shaped targets 133 on which the actuators 132 act. The magnetic force on the rotor 108 acts to offset an axial load (e.g., thrust force) on the rotor 108 and support the rotor 108 in an axial direction, thus reducing or eliminating the axial loads on the primary bearing system 128. The primary bearing system 128, of course, still fully, radially supports the rotor 108. Yet, by reducing or eliminating the axial loads on the primary bearing system 128, the frictional losses due to the bearing system 128 are reduced. In certain instances, as discussed below, the electromagnetic actuators 132 can be sized smaller than is necessary to support the full axial load of the rotor 108 at the maximum operating condition of the engine 102.

A controller 134, connected to the electromagnetic actuators 132 and the engine 102, controls the magnetic force of the electromagnetic actuators 132 on the rotor 108. The controller 134 can control the electromagnetic actuators 132 individually, in one or more groups, or as a whole. The controller 134 controls the magnetic force of the electromagnetic actuator(s) 132 based on the operational state of the engine 102, for example, such that the magnetic force of the electromagnetic actuators 132 increases, decreases, or stays the same based on a change in the operational state of the engine 102 and/or based on one or more engine operational thresholds. The controller 134 can be configured to control the actuators 132 in a manner that reduces turbocharger losses and/or improves efficiency at operating conditions less than the engine nominal steaming operation, such as during slow steaming.

In some instances, the controller 134 controls the axial forces applied on the rotor by the electromagnetic actuators 132 in a continuously variable relationship to the engine operation, e.g., proportional to engine operation and/or by some other function. In some instances, the controller 134 controls the axial forces applied on the rotor by the electromagnetic actuators 132 as a step function, in response to one or more engine operational thresholds. An engine operational threshold can include a specified engine speed, a specified engine power output, and/or another specified engine operational characteristic. In certain instances, the electromagnetic actuators 132 can support some, none, or all of an axial load on the rotor 108 when the operational state of the engine 102 is below, at, or above a specified engine speed or engine power output. In certain instances, the controller 134 controls one or more of the electromagnetic actuators 132 to support all axial load on the rotor 108 below and up to an engine operational threshold. In certain instances, the threshold is a specified engine 102 operational state, such as a nominal steaming operational state, an engine maximum operational state (e.g., maximum speed and/or power output), or some percent (e.g., 50%, 70%, 90% or other portion) of the nominal steaming, maximum or other engine operational state. In certain instances, the electromagnetic actuators 132 act on and apply a force to the rotor 108 to support all axial load on the rotor 108 when the engine operational state is below an engine operational threshold. Further, in certain instances, the electromagnetic actuators 132 refrain from applying a force on the rotor 108 when the engine operational state is above the engine operational threshold. In certain instances, the controller 134 controls one or more of the electromagnetic actuators 132 to share support of the axial load on the rotor with the primary bearing system 128 between the engine operational threshold and the specified operational state of the engine, or between two different engine operational thresholds. For example, the engine can have a first operational threshold of the specified engine operational state and a second, different operational threshold of the specified engine operational state. When the engine operational state is below the first operational threshold, the controller 134 can control the electromagnetic actuators 132 to act on and apply a first force on the rotor to support a portion of an axial load on the rotor 108, and the primary bearing system 128 supports the remainder (if any) of the axial load on the rotor 108. When the engine operational state is between the first and second operational thresholds, the controller 134 can control the electromagnetic actuators 132 to act on and apply a second, different force (e.g., a greater or lesser force) on the rotor to support a portion of an axial load on the rotor 108, and the primary bearing system 128 supports the remainder of the axial load on the rotor 108. The portion of the axial load can correlate to between 0% and 100% (e.g., 30% to 90%) of the axial load on the rotor 108. In some instances, the controller 134 controls one or more of the electromagnetic actuators 132 to not support any axial load on the rotor 108 at the specified operational state of the engine 102 or higher, allowing all of the axial load on the rotor 108 to be completely axially supported by the primary bearing system 128. In certain instances, the magnetic force on the rotor 108 from the electromagnetic actuators 132 is a function of the engine operational state. For example, the controller 134 can implement a step function in controlling the electromagnetic actuators 132, such that a specified percentage change or specified value change in the engine speed or power output results in a specified change in the magnetic force on the rotor 108 from the electromagnetic actuators 132. In addition to or as an alternative to the control schemes above, the controller 134 can be manually adjusted, in response to a user input, to adjust the amount of force applied by the electromagnetic actuators 132 on the rotor 108.

The electromagnetic actuators 132 provide a unidirectional force to the rotor 108, for example, along the central rotational axis A-A in the direction opposite an axial thrust force. In some instances, the electromagnetic actuators 132 can provide a bidirectional axial force. The electromagnetic actuators 132 can act to reduce or offload an axial load on the primary bearing system 128, for example, on a fluid film bearing of the primary bearing system 128. In some instances, the controller 134 and/or another controller controls a bearing fluid flow rate to the primary bearing system 128 based on the magnetic force from the electromagnetic actuators 132 and/or the engine operational state. For example, when increasing an applied axial force on the rotor 108 from the electromagnetic actuators 132, the controller 134 can reduce the bearing fluid flow rate to the primary bearing system 128. When decreasing an applied axial force on the rotor 108 from the electromagnetic actuators 132, the controller can increase the bearing fluid flow to the primary bearing system 128. In instances when the electromagnetic actuators 132 support all axial load on the rotor 108, the controller can restrict bearing fluid flow to the primary bearing system 128 to allow only as much bearing fluid flow as is needed to prevent damage to the fluid film bearing. Reducing bearing fluid flow to the primary bearing system 128 while the electromagnetic actuators 132 are supporting some or all of the axial load on the rotor 108 can further reduce bearing losses and increase turbocharger efficiency.

In some instances, the controller 134 can adjust the axial force applied by the electromagnetic actuators to control the gap between the edges of the compressor 104 and the housing 110. In doing so, the controller 134 can control the amount of air that bleeds past the compressor 104, and thus, the efficiency of the compressor 104. For example, when the mechanical loads on the rotor 108 tend to grow the gap, tending to make the compressor less efficient, the controller 134 can operate to reduce the gap between the edges of the compressor 104 and the inner surface of the housing 110 to improve the compressor 104, and thus turbocharger, efficiency.

In some instances, a portion of the compressed air output from the compressor 104 is bled off and supplied to increase pressure in a region of the turbocharger system 100 that counteracts axial forces on the compressor 104, turbine 106 and rotor 108. However, the electromagnetic actuators 132 can be operated to offset these axial forces, thus partially reducing or completely eliminating the need to use the compressed air in this manner. Reducing and/or omitting the bleed off of compressed air can increase efficiency of the turbocharger system 100, because more of the compressed air output from compressor 104 is available for use by the engine 102.

Although FIG. 1 shows four electromagnetic actuators 132, the turbocharger system 100 can include a different number of electromagnetic actuators 132. For example, the turbocharger system 100 can include one, two, three, or more electromagnetic actuators 132. Size and placement of the electromagnetic actuators 132 can vary, for example, based on turbocharger load characteristics, desired flexibility, and/or other factors. In some examples, one or more (e.g., all) of the electromagnetic actuators 132 can be sized to support less than all of the axial load capacity of the primary bearing system 128. For example, an example primary bearing system with a load capacity of 8,000 lbs. can be supported by an electromagnetic actuator configured to support up to 50% (4,000 lbs.) of the axial load capacity of the example primary bearing system. Providing one or more electromagnetic actuators 132 sized to support less than all of the load capacity of the primary bearing system 128 can yield a lower cost system (smaller actuators are typically less expensive than larger actuators) and can facilitate fitting the actuators into the turbocharger and/or retrofitting the actuators to a turbocharger design not originally designed to accommodate the actuators. In some instances, one electromagnetic actuator 132 can support the axial loads mentioned above, where additional electromagnetic actuators 132 provide redundant support for the rotor 108. In certain instances, multiple electromagnetic actuators 132 of FIG. 1 can additively provide the axial support of the rotor 108.

FIG. 1 shows the electromagnetic actuators 132 along the rotor at locations between the compressor 104 and turbine 106, and at a location adjacent the rotor 108 extending beyond the compressor 104 away from the turbine 106. In some instances, an electromagnetic actuator 132 is placed at a location adjacent the rotor 108, about a portion of the rotor 108 extending beyond the turbine 106 away from the compressor 104. FIG. 1 shows each of the electromagnetic actuators 132 as adjacent the radially protruding disc shaped targets 133 extending from the rotor. In some instances, the electromagnetic actuators 132 are within a radial recess of the rotor 108, adjacent a different part of the rotor 108, and/or placed elsewhere adjacent the rotor 108. In certain instances, the electromagnetic actuators 132 are mounted to the turbocharger housing 110.

Figure 2:
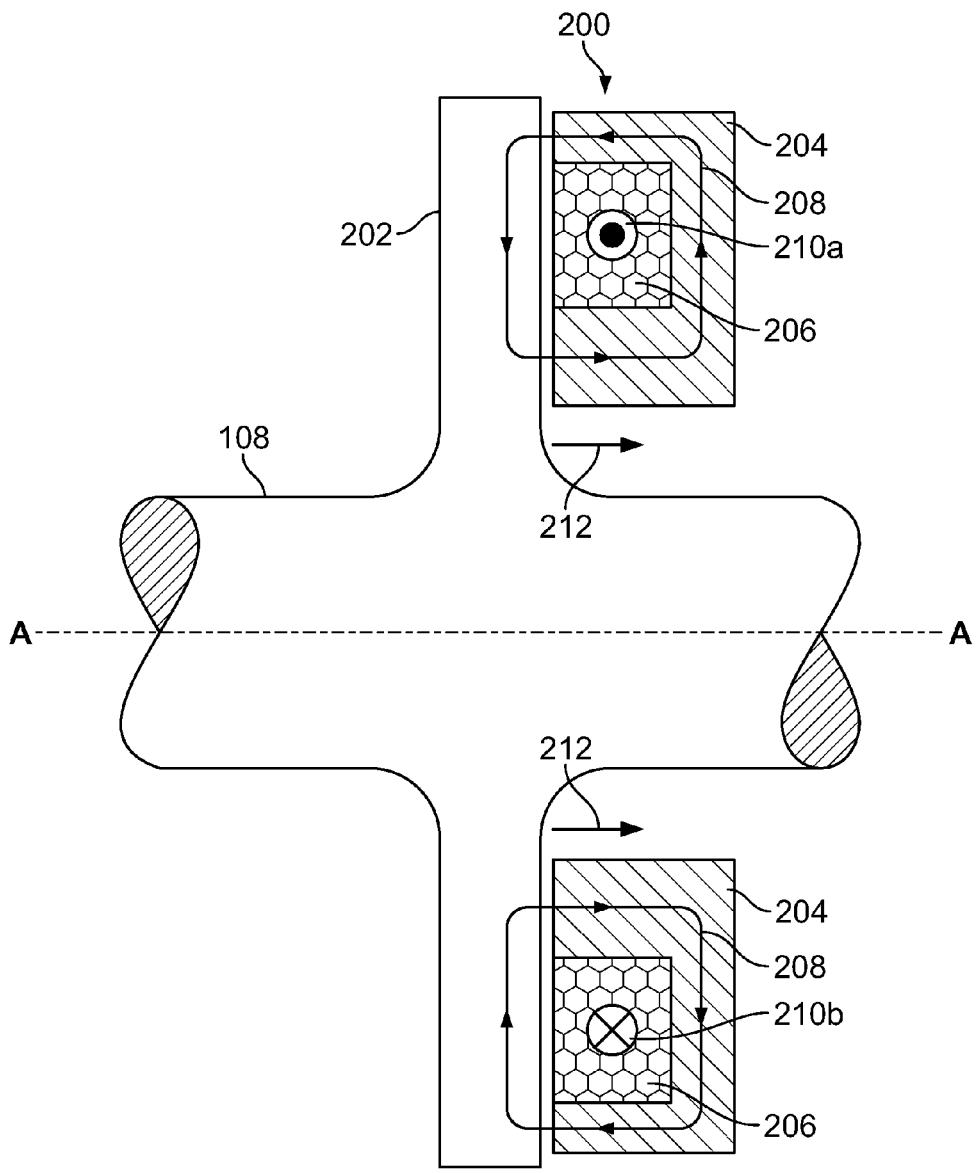
FIG. 2 is a partial cross-sectional side view of an example electromagnetic actuator and rotor.

FIG. 2 is a partial cross-sectional side view of an example electromagnetic actuator 200 that could be used as one of the electromagnetic actuators 132 of FIG. 1. The example electromagnetic actuator 200 is adjacent a disc shaped target 202 (e.g., the disc shaped targets 133 of FIG. 1) radially protruding from a rotor (e.g., the rotor 108 of FIG. 1). The example electromagnetic actuator includes an electromagnet 204 including coils 206 adjacent the disc shaped target 202 and circling the rotor 108. The coils 206 are arranged so that, when energized, they form an electromagnet that produces a magnetic field 208 that acts on and applies force to the disc shaped target 202. In FIG. 2, the coils 206 move out of the page at the first coil direction 210*a* and into the page at a second coil direction 210*b*. The coil directions 210*a* and 210*b* define a direction of the magnetic field 210. For example, the electromagnetic actuator 200 can apply an axial force on the disc shaped target 202 in a direction parallel to the central rotational axis A-A based on the magnetic field 208 and a current supplied to the coils 206. The current defines a variable control field of the electromagnet that coincides with the magnetic field 208. An increase or decrease in the current supplied to the coils 206 causes an increase or decrease, respectively, of a magnitude of the variable control field, and therefore an increase or decrease, respectively, of the axial force on the disc shaped target 202. In the example electromagnetic actuator 200 of FIG. 2, the electromagnetic actuator 200 can apply an axial force in a first direction 212 from the disc shaped target 202 to the electromagnetic actuator 200, where the electromagnetic actuator 200 acts to pull the disc shaped target 202 toward the coils 206. In certain instances, the electromagnet 204 allows for control of the axial force on the rotor 108, for example, by the controller 134 of FIG. 1.

Figure 3A:
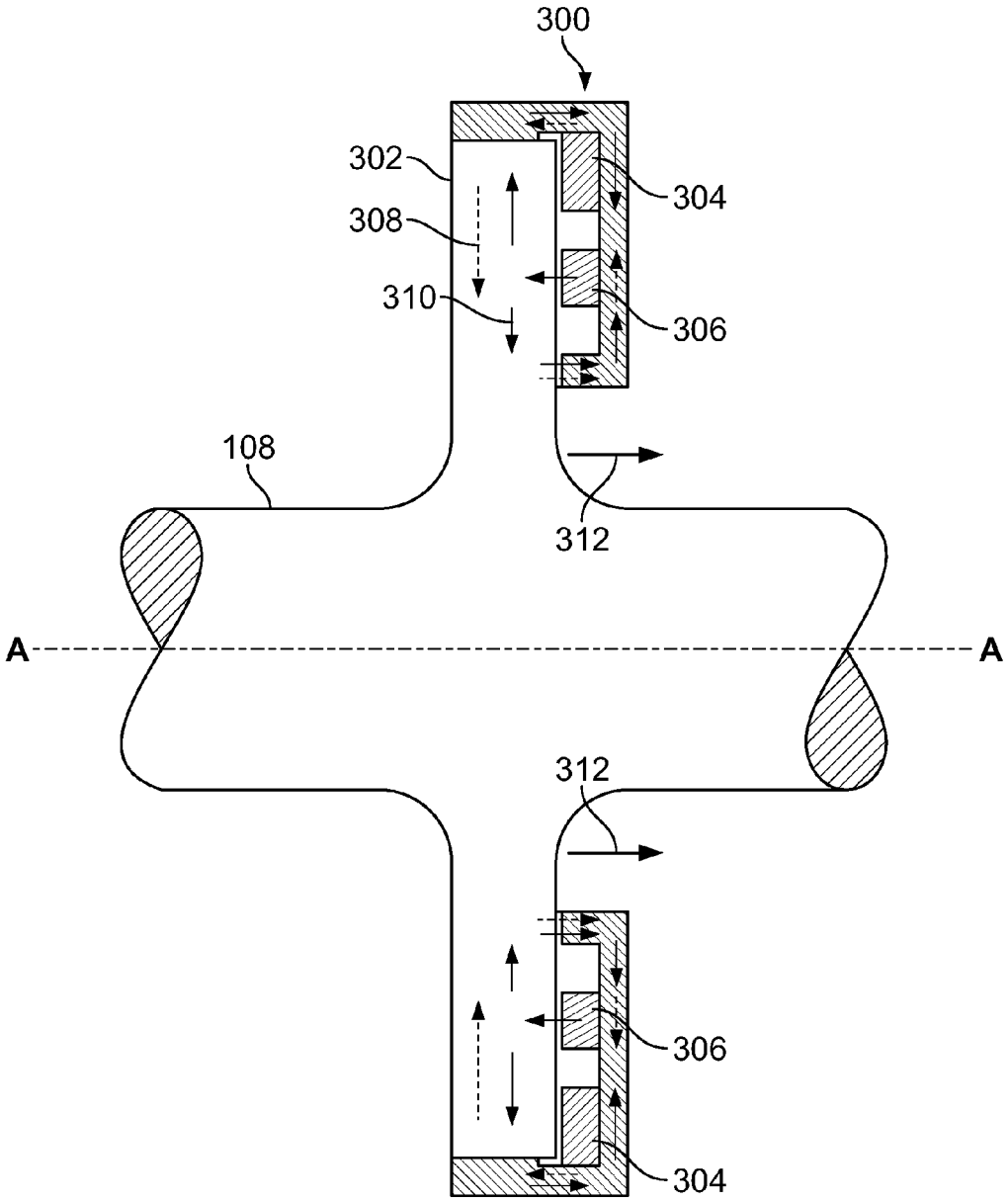
FIGS. 3A and 3B are partial cross-sectional side views of an example electromagnetic actuator including a permanent magnet and rotor.
Figure 3B:
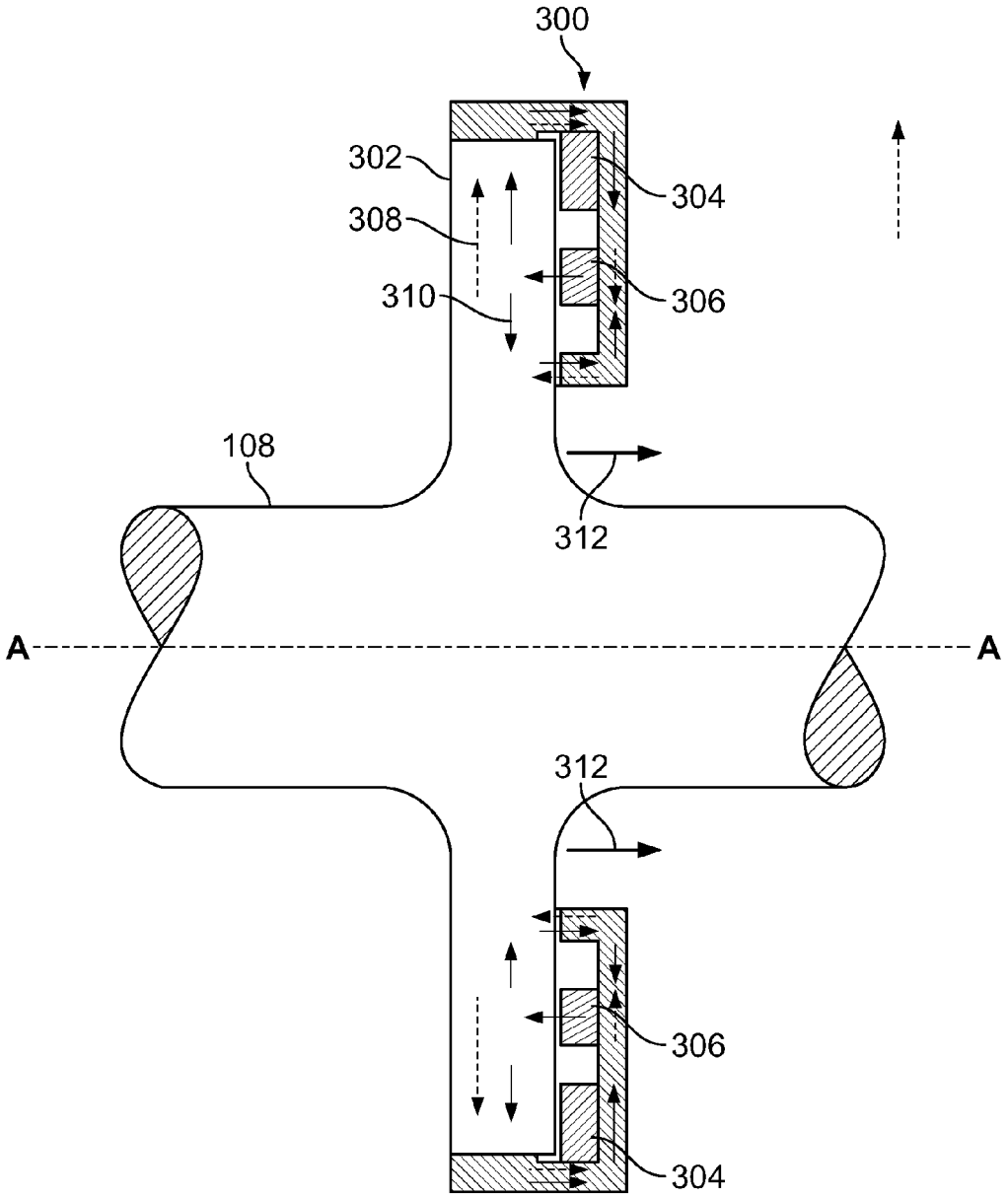

In some instances, an electromagnetic actuator includes a permanent magnet to apply a constant bias field on the rotor. For example, referring to FIGS. 3A and 3B, an example electromagnetic actuator 300 adjacent the disc shaped target 302 radially protruding from a rotor (e.g., the rotor 108 of FIG. 1) is shown as including an electromagnet 304 and a permanent magnet 306. The electromagnet 304 provides a variable control field 308 on the disc shaped target 302 of the rotor in an axial direction parallel to the central rotational axis A-A, and the permanent magnet 306 provides a constant bias field 310. The constant bias field 310 additively combines with the variable control field 308 of the electromagnet 304 to produce a resultant axial force 312 on the rotor 108. The permanent magnet 306 acts to provide a fixed, constant magnetic field on the rotor 108, while the electromagnet 304 acts to provide a variable magnetic field on the rotor 108. For example, FIG. 3A depicts the constant bias field 310 from the permanent magnet 306, where the variable control field 308 of the electromagnet 304 increases the resultant axial force 312 from the net magnetic field acting on the rotor 108. In the example depicted in FIG. 3B, the variable control field 308 of the electromagnet 304 decreases the resultant axial force 312 from the net magnetic field acting on the rotor 108. The permanent magnet 306 allows for linear control of the axial force on the rotor 108, for example, without complex control. In certain instances, including a permanent magnet in the example electromagnetic actuator 300 reduces the amount of supplied current needed to achieve a specified axial magnetic force as compared to the example electromagnetic actuator 200 of FIG. 2 that excludes a permanent magnet.

In view of the discussion above, certain aspects encompass a turbocharger system for an engine, where the turbocharger system includes a rotor, a primary bearing system arranged to axially and radially support the rotor to rotate on a central rotational axis, a compressor coupled to a rotor to rotate with the rotor, a turbine coupled to the rotor to rotate with the rotor, and an electromagnetic actuator adjacent to the rotor. The electromagnetic actuator selectively acts on the rotor and supplements the axial support of the primary bearing system by applying a magnetic force on the rotor in a direction parallel to the central rotational axis of the rotor.

Certain aspects encompass, a method including identifying an operational state of an engine operably connected to a turbocharger system, where the turbocharger system includes a compressor and a turbine carried by a rotor to rotate on a central rotational axis, an electromagnetic actuator, and a primary bearing system to axially support and radially support the rotor. The method includes, in response to the operational state of the engine, selectively acting on the rotor to apply an axial force on the rotor using the electromagnetic actuator and reducing a load on the primary bearing system.

Certain aspects encompass, a turbocharger bearing support system for a turbocharger of an engine includes a primary bearing system within the turbocharger and adjacent a rotor of the turbocharger, the primary bearing system including a fluid film bearing arranged about the rotor to axially and radially support the rotor to rotate on a central rotational axis, and a secondary bearing system adjacent to the rotor to selectively act on the rotor and supplement the axial support of the primary bearing system by applying a magnetic force on the rotor in a direction parallel to the central rotational axis of the rotor, where the secondary bearing system includes an electromagnetic actuator. The turbocharger is operably attached to the engine, the primary bearing system supports a maximum axial load on the rotor at a maximum operational state of the engine, and the secondary bearing system supports at least a portion of the axial load on the rotor at an operational state of the engine less than the maximum operational state.

The aspects above can include some, none, or all of the following features. The electromagnetic actuator is configured to support up to 50% of an axial load capacity of the primary bearing system on the rotor. The turbocharger is operably connected to an engine, and the primary bearing system is configured to support a maximum axial load on the rotor at a maximum operational state of the engine. The turbocharger system includes a controller coupled to the electromagnetic actuator, the controller configured to control a variable magnetic force of the electromagnetic actuator on the rotor based on an operational state of the engine. The controller controls the electromagnetic actuator to support the entire axial load on the rotor up to a first engine operational threshold, share support of the entire axial load on the rotor with the primary bearing system between the first engine operational threshold and a second engine operational threshold, and not support any axial load on the rotor at and above the second engine operational threshold. The first and second engine operational thresholds include at least one of a specified engine speed or a specified engine power output. The controller controls the electromagnetic actuator to support at least a portion of an axial load on the rotor up to an engine operational threshold and not support any axial load on the rotor at and above the engine operational threshold, and the engine operational threshold includes at least one of a specified engine speed or a specified engine power output. The electromagnetic actuator includes a permanent magnet and an electromagnet, the permanent magnet is configured to apply a constant bias field on the rotor, and the electromagnet is configured to apply a variable control field on the rotor. The electromagnetic actuator is between the compressor and the turbine. A portion of the rotor extends away from the turbine and beyond the compressor along the central rotational axis, and the electromagnetic actuator is adjacent the portion of the rotor. A portion of the rotor extends away from the compressor and beyond the turbine along the central rotational axis, and the electromagnetic actuator is adjacent the portion of the rotor. The rotor includes a radially protruding disc, and the electromagnetic actuator is configured to act on the protruding disc of the rotor. The primary bearing system includes a fluid film bearing, and the method includes adjusting a bearing fluid flow to the fluid film bearing while applying an axial force on the rotor using the electromagnetic actuator. The method includes supporting, with the bearing system, a maximum axial load on the rotor at a maximum operational load of the engine without acting on the rotor to apply the axial force using the electromagnetic actuator. Selectively acting on the rotor to apply an axial force on the rotor using the electromagnetic actuator includes, for an operational state of the engine up to a first specified engine condition, acting on the rotor to support a full axial load on the rotor. Selectively acting on the rotor to apply an axial force on the rotor using the electromagnetic actuator includes, for an operational state of the engine between the first specified engine condition and a second specified engine condition, acting on the rotor to support a partial axial load on the rotor. Selectively acting on the rotor to apply an axial force on the rotor using the electromagnetic actuator includes, for an operational state at or above the second specified engine condition, not supporting an axial load on the rotor. The first and second specified engine conditions include at least one of a specified engine speed or a specified engine power output. Selectively acting on the rotor to apply an axial force on the rotor using an electromagnetic actuator includes applying a variable control field on the rotor from an electromagnet of the electromagnetic actuator and a constant bias field on the rotor from a permanent magnet of the electromagnetic actuator. The operational state of the turbocharger system includes a rotation of the compressor of the turbocharger system to cause a second axial force on the rotor, the first mentioned axial force on the rotor from the electromagnetic actuator is in a first direction, and the second axial force on the rotor from the rotation of the compressor is in a second direction opposing the first direction. The turbocharger bearing support system includes a controller coupled to the electromagnetic actuator of the secondary bearing system to control a current through the electromagnetic actuator based on the operational state of the engine. The controller is coupled to the fluid film bearing of the primary bearing system to control an amount of fluid supplied to the fluid film bearing based on the magnetic force on the rotor from the secondary bearing system.

A number of embodiments have been described. Nevertheless, it will be understood that various modifications may be made. Accordingly, other embodiments are within the scope of the following claims.

What is claimed is:

1. A turbocharger system for an engine, comprising:

a rotor;

a primary bearing system arranged to axially and radially support the rotor to rotate on a central rotational axis;

a compressor coupled to the rotor to rotate with the rotor;

a turbine coupled to the rotor to rotate with the rotor;

an electromagnetic actuator adjacent to the rotor to selectively act on the rotor and supplement the axial support of the primary bearing system by applying a magnetic force on the rotor in a direction parallel to the central rotational axis of the rotor; and a controller coupled to the electromagnetic actuator and to an engine to control a current through the electromagnetic actuator based on an operational state of the engine, the operational state of the engine comprising a power output of the engine, the controller configured to receive an input from the engine indicative of the operational state of the engine and to control the current through the electromagnetic actuator based on the received input and control the magnetic force on the rotor from the electromagnetic actuator as a step function of engine power output thresholds of the received input.

2. The turbocharger system of claim 1, where the electromagnetic actuator is configured to support up to 50% of an axial load capacity of the primary bearing system on the rotor.

3. The turbocharger system of claim 1, where the turbocharger is operably connected to the engine, and where the primary bearing system is configured to support a maximum axial load on the rotor at a maximum operational state of the engine.

4. The turbocharger system of claim 1, where the controller controls the electromagnetic actuator to support an entire axial load on the rotor up to a first engine power output, share support of the entire axial load on the rotor with the primary bearing system between the first engine power output and a second engine power output, and not support any axial load on the rotor at and above the second engine power output.

5. The turbocharger system of claim 1, where the controller controls the electromagnetic actuator to support at least a portion of an axial load on the rotor up to an engine power output and not support any axial load on the rotor at and above the engine power output.

6. The turbocharger system of claim 1, where the electromagnetic actuator comprises a permanent magnet and an electromagnet, the permanent magnet configured to apply a constant bias field on the rotor, and the electromagnet configured to apply a variable control field on the rotor.

7. The turbocharger system of claim 1, where the electromagnetic actuator is between the compressor and the turbine.

8. The turbocharger system of claim 1, where a portion of the rotor extends away from the turbine and beyond the compressor along the central rotational axis, and where the electromagnetic actuator is adjacent the portion of the rotor.

9. The turbocharger system of claim 1, where a portion of the rotor extends away from the compressor and beyond the turbine along the central rotational axis, and where the electromagnetic actuator is adjacent the portion of the rotor.

10. The turbocharger system of claim 1, the rotor comprising a radially protruding disc, the electromagnetic actuator configured to act on the protruding disc of the rotor.

11. A method comprising:

identifying an operational state of an engine operably connected to a turbocharger system, the operational state of the engine comprising a power output of the engine, the turbocharger system comprising a compressor and a turbine carried by a rotor to rotate on a central rotational axis, an electromagnetic actuator, a primary bearing system to axially support and radially support the rotor, and a controller coupled to the electromagnetic actuator and to the engine to control a current through the electromagnetic actuator;

receiving, with the controller, an input from the engine indicative of an operational state of the engine, and in response to receiving the input from the engine indicative of the operational state of the engine, selectively acting on the rotor to apply an axial force on the rotor as a step function of engine power output thresholds of the received input using the electromagnetic actuator and reducing a load on the primary bearing system.

12. The method of claim 11, where the primary bearing system comprises a fluid film bearing, the method comprising adjusting a bearing fluid flow to the fluid film bearing while applying the axial force on the rotor using the electromagnetic actuator.

13. The method of claim 11, the method comprising supporting, with the primary bearing system, a maximum axial load on the rotor at a maximum operational load of the engine without acting on the rotor to apply the axial force using the electromagnetic actuator.

14. The method of claim 11, where selectively acting on the rotor to apply the axial force on the rotor using the electromagnetic actuator comprises: for the operational state of the engine up to a first specified power output, acting on the rotor to support a full axial load on the rotor; for the operational state of the engine between the first specified power output and a second specified power output, acting on the rotor to support a partial axial load on the rotor; and for the operational state at or above the second specified power output, not supporting an axial load on the rotor.

15. The method of claim 11, where selectively acting on the rotor to apply an axial force on the rotor using an electromagnetic actuator comprises applying a variable control field on the rotor from an electromagnet of the electromagnetic actuator and a constant bias field on the rotor from a permanent magnet of the electromagnetic actuator.

16. The method of claim 11, where the operational state of the turbocharger system comprises a rotation of the compressor of the turbocharger system to cause a second axial force on the rotor; and where the first mentioned axial force on the rotor from the electromagnetic actuator is in a first direction, and where the second axial force on the rotor from the rotation of the compressor is in a second direction opposing the first direction.

17. The method of claim 11, further comprising controlling, with the controller, an amount of fluid supplied to the fluid film bearing of the primary bearing system based on the magnetic force on the rotor from the electromagnetic actuator.

18. A turbocharger bearing support system for a turbocharger of an engine, the turbocharger bearing support system comprising:

a primary bearing system within the turbocharger and adjacent a rotor of the turbocharger, the primary bearing system comprising a fluid film bearing arranged about the rotor to axially and radially support the rotor to rotate on a central rotational axis;

a secondary bearing system adjacent to the rotor to selectively act on the rotor and supplement the axial support of the primary bearing system by applying a magnetic force on the rotor in a direction parallel to the central rotational axis of the rotor, the secondary bearing system comprising an electromagnetic actuator; and a controller coupled to the electromagnetic actuator of the secondary bearing system and to an engine to control a current through the electromagnetic actuator based on an operational state of the engine, the operational state of the engine comprising a power output of the engine, the controller configured to receive an input from the engine indicative of the operational state of the engine and to control the current through the electromagnetic actuator based on the received input and control the magnetic force on the rotor from the electromagnetic actuator as a step function of engine power output thresholds of the received input;

where the turbocharger is operably attached to the engine, where the primary bearing system supports a maximum axial load on the rotor at a maximum operational state of the engine, and where the secondary bearing system supports at least a portion of the axial load on the rotor at the operational state of the engine less than the maximum operational state.

19. A turbocharger bearing support system for a turbocharger of an engine, the turbocharger bearing support system comprising:

a primary bearing system within a turbocharger and adjacent a rotor of the turbocharger, the primary bearing system comprising a fluid film bearing arranged about the rotor to axially and radially support the rotor to rotate on a central rotational axis;

a secondary bearing system adjacent to the rotor to selectively act on the rotor and supplement the axial support of the primary bearing system by applying a magnetic force on the rotor in a direction parallel to the central rotational axis of the rotor, the secondary bearing system comprising an electromagnetic actuator; and a controller coupled to the electromagnetic actuator of the secondary bearing system to control a current through the electromagnetic actuator based on an operational state of the engine;

where the turbocharger is operably attached to an the engine, where the primary bearing system supports a maximum axial load on the rotor at a maximum operational state of the engine, where the secondary bearing system supports at least a portion of the axial load on the rotor at an operational state of the engine less than the maximum operational state, and where the controller is coupled to the fluid film bearing of the primary bearing system to control an amount of fluid supplied to the fluid film bearing based on the magnetic force on the rotor from the secondary bearing system.

* * * * *